US009534832B2

(12) United States Patent
Moon et al.

(10) Patent No.: US 9,534,832 B2
(45) Date of Patent: Jan. 3, 2017

(54) REFRIGERATOR

(71) Applicant: Samsung Electronics Co., Ltd., Suwon-si (KR)

(72) Inventors: Young Kyu Moon, Gwangju (KR); Hyun Myung Lee, Gwangju (KR); Eui Young Chang, Anyang-si (KR); Gyu Hyun Jo, Gwang-ju (KR); Chang Sun Lee, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/900,039

(22) Filed: May 22, 2013

(65) Prior Publication Data

US 2013/0313958 A1 Nov. 28, 2013

(30) Foreign Application Priority Data

May 23, 2012 (KR) ..... 10-2012-0054693

(51) Int. Cl.
*F25D 23/04* (2006.01)
*F25D 25/02* (2006.01)
(Continued)

(52) U.S. Cl.
CPC ..... *F25D 25/02* (2013.01); *B65D 81/053* (2013.01); *F25D 23/04* (2013.01);
(Continued)

(58) Field of Classification Search
CPC F25D 2400/32; F25D 23/067; F25D 2325/00; F25D 2325/021; F25D 2325/022; F25D 2325/023; F25D 25/02; F25D 23/00; F25D 23/04; B29C 44/12; B29C 44/14; B29C 44/16; B65D 2585/6815; B65D 2585/6817; B65D 59/00; B65D 81/05; B65D 81/051; B65D 81/053
(Continued)

(56) References Cited

U.S. PATENT DOCUMENTS 3,809,232 A * 5/1974 Kennington ..... 206/320
3,896,930 A * 7/1975 Collin ..... 206/320
(Continued)

FOREIGN PATENT DOCUMENTS

CN 2081823 7/1991
CN 1765708 5/2006
(Continued)

OTHER PUBLICATIONS

Extended European Search Report dated Jan. 14, 2016 in European Patent Application No. 13168934.1.
(Continued)

*Primary Examiner* — Daniel J Troy
*Assistant Examiner* — Ryan A Doyle
(74) *Attorney, Agent, or Firm* — Staas & Halsey LLP

(57) ABSTRACT

A structure for packaging an interior part such as a shelf and a door guard to prevent the interior part from being damaged due to impact and friction during transportation of a refrigerator is provided. Each of the shelf and the door guard may be accommodated in a shock-absorbing member in a state of being separated from each mounting portion to be fixed within a storage chamber. The shock-absorbing member coupled with the shelf or the door guard may be packaged by a package member and be fixed to a shelf mounting portion of an inner case.

10 Claims, 7 Drawing Sheets

(51) Int. Cl.

| | |
|---|---|
| ***B65D 81/05*** | (2006.01) |
| *F25D 23/06* | (2006.01) |
| *F25D 23/00* | (2006.01) |

(52) U.S. Cl.
CPC ..... *B65D 2585/6815* (2013.01); *B65D 2585/6817* (2013.01); *F25D 23/00* (2013.01); *F25D 23/067* (2013.01); *F25D 2400/32* (2013.01)

(58) Field of Classification Search
USPC ..... 312/404, 408, 351, 352; 206/320, 523, 206/586, 326, 497
See application file for complete search history.

(56) References Cited

U.S. PATENT DOCUMENTS

| | | | | |
|---|---|---|---|---|
| 4,848,581 | A * | 7/1989 | Besore et al. | 206/521 |
| 5,435,441 | A * | 7/1995 | Tiedt et al. | 206/320 |
| 5,701,999 | A | 12/1997 | Phillips, II et al. | |
| 5,862,911 | A * | 1/1999 | Phillips et al. | 206/320 |
| 6,422,673 | B1 | 7/2002 | Bienick | |
| 8,646,857 | B2 * | 2/2014 | Schillkowski | 312/401 |
| 2007/0090243 | A1 | 4/2007 | Downing | |
| 2009/0293533 | A1 * | 12/2009 | Lim | F25D 25/02 62/465 |

FOREIGN PATENT DOCUMENTS

| | | | | |
|---|---|---|---|---|
| DE | 19621542 | A1 * | 12/1997 | B65D 25/10 |
| EP | 1378460 | A1 * | 1/2004 | B65D 81/05 |
| EP | 1655564 | | 5/2006 | |
| JP | 6-312783 | | 11/1994 | |
| KR | 1999-0035662 | | 9/1999 | |
| KR | 10-2005-0087127 | | 8/2005 | |
| WO | 2009/037123 | | 3/2009 | |
| WO | WO 2009037123 | A2 * | 3/2009 | |
| WO | WO 2009121844 | A1 * | 10/2009 | |

OTHER PUBLICATIONS

Chinese Office Action issued Jun. 28, 2016 in Chinese Patent Application No. 201310192416.3.

* cited by examiner

REFRIGERATOR

CROSS-REFERENCE TO RELATED APPLICATIONS

This application claims the priority benefit of Korean Patent Application No. 10-2012-54693, filed on May 23, 2012 in the Korean Intellectual Property Office, the disclosure of which is incorporated herein by reference.

BACKGROUND

1. Field

Embodiments relate to a package structure which packages an interior part such as a shelf or a door guard such that the interior part is not damaged during transportation of a refrigerator.

2. Description of the Related Art

A refrigerator is generally a home appliance which may keep food fresh by including a storage chamber able to store the food and a cold air supply device to supply the storage chamber with cold air.

The refrigerator includes a shelf which is mounted to a shelf mounting portion provided in an inner case, and interior parts such as a door guard which is mounted to a door guard mounting portion provided at the rear of a door.

These interior parts are mounted to the respective mounting portions in an individually plastic-packaged state so as to prevent foreign matter such as dust from adhering thereto, and are then fixed by shock-absorbing members, each of which is made of a corrugated board or a Styrofoam material, so as to prevent damage due to impact during transportation of the refrigerator.

However, individually packaging the interior parts makes packaging and releasing operations cumbersome as well as being uneconomical. In addition, fixing the shelf in a state of being mounted to the shelf mounting portion of the inner case may cause a poor external appearance such as a scratch due to friction with the shelf mounting portion.

SUMMARY

In an aspect of one or more embodiments, there is provided a structure for packaging an interior part, such as a shelf or a door guard, of a refrigerator to prevent damage due to impact applied to the interior part, to prevent foreign matter such as dust from adhering thereto, or to prevent a poor external appearance due to friction, during transportation of the refrigerator.

In an aspect of one or more embodiments, there is provided a refrigerant including a main body having an inner case and an outer case, a storage chamber which is defined to be opened at a front surface thereof by the inner case, a door to open and close the opened front surface of the storage chamber, a shelf mounting portion which is provided in the inner case, a shelf which is separably mounted to the shelf mounting portion, and a shock-absorbing member which accommodates the shelf separated from the shelf mounting portion and which is fixed within the storage chamber, so as to fix the shelf separated from the shelf mounting portion within the storage chamber.

The shock-absorbing member may include a fixing portion coupled to the shelf mounting portion, and the shock-absorbing member may be fixed within the storage chamber by coupling the fixing portion to the shelf mounting portion.

The shelf mounting portion may have a protrusion shape which protrudes from the inner case, and the fixing portion may have a groove shape into which the shelf mounting portion is able to be inserted.

The refrigerator may further include a stopper member to fix the shock-absorbing member within the storage chamber, and the shock-absorbing member may be closely arranged between the inner case and the stopper member to be fixed within the storage chamber.

The shelf accommodated in the shock-absorbing member may be spaced apart from the inner case and the door.

The refrigerator may further include a package member which packages the shock-absorbing member and the shelf accommodated in the shock-absorbing member.

The shock-absorbing member may be made of a Styrofoam material.

The stopper member may be made of a Styrofoam material.

The package member may be a heat-shrinkable film.

In an aspect of one or more embodiments, there is provided a refrigerator including a main body having an inner case and an outer case, a storage chamber which is defined to be opened at a front surface thereof by the inner case, a door to open and close the opened front surface of the storage chamber, a shelf mounting portion which is provided in the inner case, a shelf which is separably mounted to the shelf mounting portion, a door guard mounting portion which is provided on the door, a door guard which is separably mounted to the door guard mounting portion, and a shock-absorbing member which accommodates any one of the shelf separated from the shelf mounting portion and the door guard separated from the door guard mounting portion, and which is fixed within the storage chamber, so as to fix any one of the shelf separated from the shelf mounting portion and the door guard separated from the door guard mounting portion within the storage chamber.

Any one of the shelf and the door guard accommodated in the shock-absorbing member may be spaced apart from the inner case and the door.

The refrigerator may further include a package member which packages the shock-absorbing member and any one of the shelf and the door guard accommodated in the shock-absorbing member.

The shock-absorbing member may be made of a Styrofoam material.

The package member may be a heat-shrinkable film.

In an aspect of one or more embodiments, there is provided a refrigerator includes a main body having an inner case and an outer case, a storage chamber which is defined to be opened at a front surface thereof by the inner case, a door to open and close the opened front surface of the storage chamber, a shelf mounting portion which is provided in the inner case, and a shelf packaging assembly which includes a shelf able to be mounted to the shelf mounting portion, a shelf shock-absorbing member accommodating the shelf, and a package member packaging the shelf shock-absorbing member and the shelf accommodated in the shelf shock-absorbing member, and which is fixed within the storage chamber.

The refrigerator may further include a door guard mounting portion which is provided on a rear surface of the door, and a door guard packaging assembly which includes a door guard able to be mounted to the door guard mounting portion, a door guard shock-absorbing member accommodating the door guard, and a package member packaging the door guard shock-absorbing member and the door guard accommodated in the shock-absorbing member, and which is fixed within the storage chamber.

The shelf shock-absorbing member may be made of a Styrofoam material.

The door guard shock-absorbing member may be made of a Styrofoam material.

The shelf package member may be a heat-shrinkable film.

The door guard package member may be a heat-shrinkable film.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
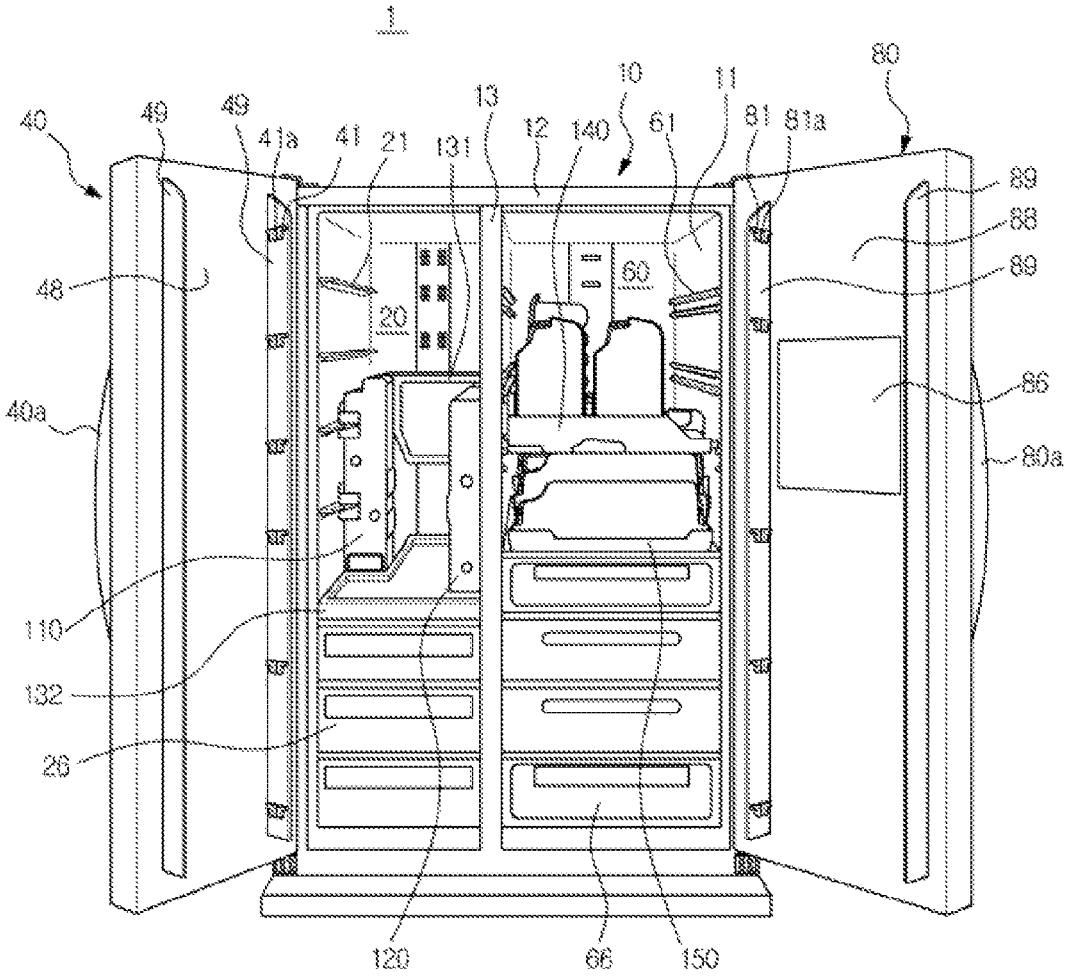
FIG. 1 is a view illustrating the inside of a refrigerator according to an embodiment.

Reference will now be made in detail to embodiments, examples of which are illustrated in the accompanying drawings, wherein like reference numerals refer to like elements throughout.

Figure 7:
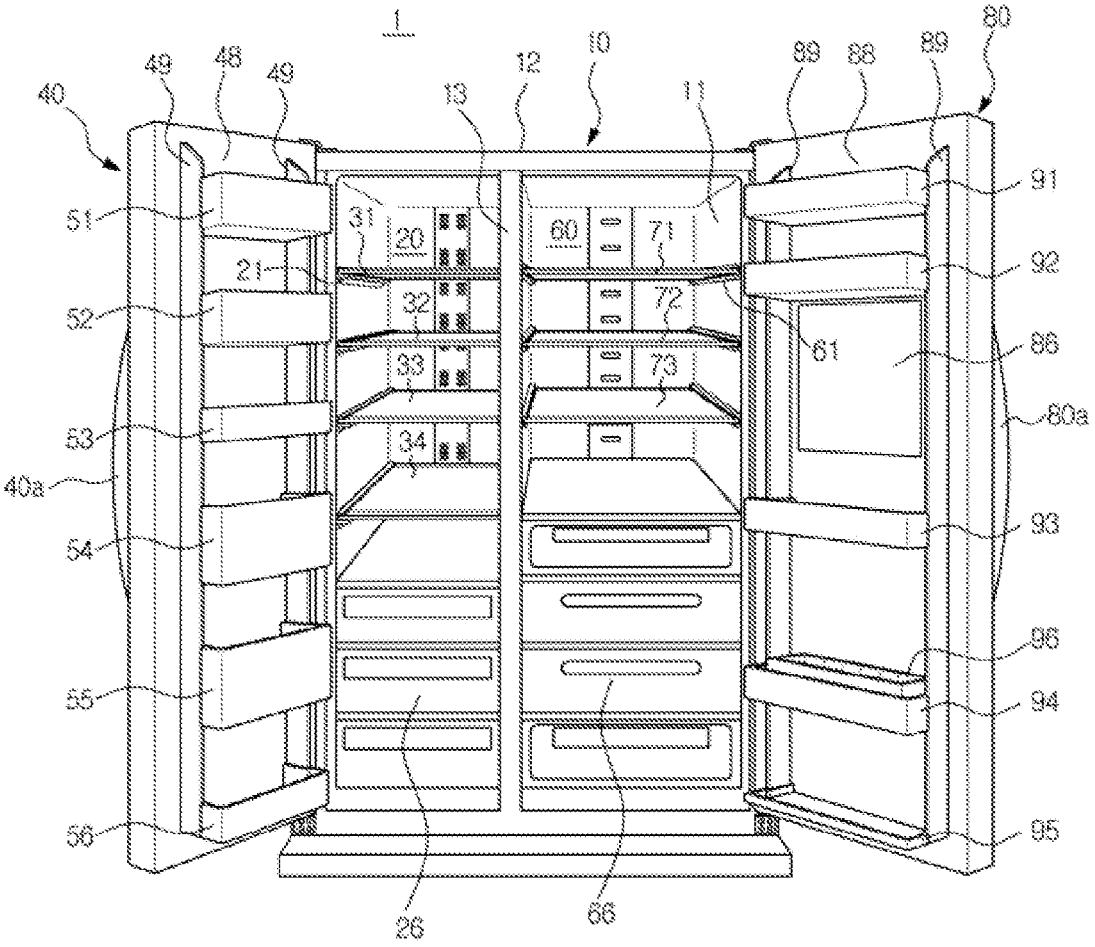
FIG. 7 is view illustrating a state of respectively mounting the shelves and the door guards to an inner case and doors after release of the shelf packaging assemblies and the door guard packaging assemblies of the refrigerator in FIG. 1.

FIG. 1 is a view illustrating the inside of a refrigerator according to an embodiment. FIG. 7 is view illustrating a state of respectively mounting shelves and door guards to an inner case and doors after release of shelf packaging assemblies and door guard packaging assemblies of the refrigerator in FIG. 1.

Referring to FIGS. 1 and 7, a refrigerator 1 includes a main body 10 configured of an inner case 11 and an outer case 12, storage chambers 20 and 60 defined within the inner case 11, and a cold air supply device to supply the storage chambers 20 and 60 with cold air.

The inner case 11 may be made of a plastic material and be integrally injection-molded. The outer case 12 may be coupled to the outer side of the inner case 11 and made of a metal material having superior durability and aesthetics. A heat insulating material 14 (see FIG. 2) to interrupt the cold air of the storage chambers 20 and 60 may be arranged between the inner case 11 and the outer case 12.

The storage chambers 20 and 60 are provided to be opened at respective front surfaces thereof so that food is put in and taken out of the storage chambers 20 and 60. The storage chambers 20 and 60 may be partitioned into a left freezing chamber 20 and a right refrigerating chamber 60 by an intermediate partition wall 13. Embodiments are not limited in terms of positions of the freezing chamber 20 and the refrigerating chamber 60. The freezing chamber 20 may be maintained at substantially 20° C. below zero, whereas the refrigerating chamber 60 may be maintained at substantially 3° C. above zero. The freezing chamber 20 and the refrigerating chamber 60 may be heat-insulated by the intermediate partition wall 13.

The freezing chamber 20 and the refrigerating chamber 60 may be respectively provided, at lower portions thereof, with a turbo cooling room 26 and a vegetable room 66 which are provided in the form of a drawer to further block discharge of the cold air. In addition, the freezing chamber 20 and the refrigerating chamber 60 may be respectively provided with shelf mounting portions 21 and 61 to which respective shelves 31 to 34 and 71 to 73 (see FIG. 7) may be mounted. Although a plurality of shelf mounting portions 21 and 61 may be provided in the respective freezing chamber 20 and refrigerating chamber 60, only one shelf mounting portion 21 in the freezing chamber 20 and one shelf mounting portion 61 in the refrigerating chamber 60 are designated by reference numerals for convenience of description.

Although four shelves 31 to 34 are arranged in the freezing chamber 20 and three shelves 71 to 73 are arranged in the refrigerating chamber 60 in the present embodiment, the embodiments are not limited as to the number of the shelves. The shelf mounting portions 21 and 61 may be arranged in the inner case 11 of the freezing chamber 20 and the refrigerating chamber 60.

The shelf mounting portions 21 and 61 may have a protrusion shape which protrudes from the inner case 11 so as to place the shelves 31 to 34 and 71 to 73 on the shelf mounting portions 21 and 61. The shelf mounting portions 21 and 61 may be formed to be elongated in the front and rear direction. The shelf mounting portions 21 and 61 may be formed integrally with the inner case 11, or be formed separately from the inner case 11 to be fixed thereto.

The main body 10 may be coupled with doors 40 and 80 to respectively open and close the opened front surface of the freezing chamber 20 and the opened front surface of the refrigerating chamber 60. The doors 40 and 80 may be pivotably hinge-coupled to the main body 10. The doors 40 and 80 may be provided with handles 40*a* and 80*a* to open and close the doors 40 and 80, respectively. The doors 40 and 80 may be provided with an auxiliary door 86 which allows internal food to be taken out without opening the doors 40 and 80.

These doors 40 and 80 may be mounted, on rear surfaces 48 and 88 thereof, with door guards 51 to 56 and 91 to 95 (see FIG. 7) to accommodate food. Although six door guards 51 to 56 are arranged on the freezing chamber door 40 and five door guards 91 to 95 are arranged on the refrigerating chamber door 80, embodiments are not limited as to the number of the door guards.

The rear surfaces 48 and 88 of the doors 40 and 80 may be respectively provided with door guard mounting portions 49 and 89 to which the door guards 51 to 56 and 91 to 95 may be mounted. Each of the door guard mounting portions 49 and 89 may be paired to protrude from each of the rear surfaces 48 and 88 of the doors 40 and 80. The door guard mounting portions 49 and 89 may extend to be vertically elongated. The door guards 51 to 56 and 91 to 95 may be mounted between the pair of door guard mounting portions 49 and between the pair of door guard mounting portions 89.

Support protrusions 41 and 81 to support the door guards 51 to 56 and 91 to 95 may protrude from the door guard mounting portions 49 and 89. The support protrusions 41 and 81 may support surfaces to be supported 51*b* (see FIG. 6) which are formed on opposite sides of the door guards 51 to 56 and 91 to 95. Although the surfaces to be supported

51*b* are formed on the opposite sides of all the door guards 51 to 56 and 91 to 95, only the surfaces to be supported 51*b* of one door guard 51 are designated by reference numeral for convenience of description.

In addition, the support protrusions 41 and 81 may have catch grooves 41*a* and 81*a* into which catch protrusions 51*a* (see FIG. 6) formed on the opposite sides of the door guards 51 to 56 and 91 to 95 may be inserted. Although the catch protrusions 51*a* are formed on the opposite sides of all the door guards 51 to 56 and 91 to 95, only the catch protrusions 51*a* of one door guard 51 are designated by reference numeral for convenience of description.

The catch protrusions 51*a* of the door guards 51 to 56 and 91 to 95 are inserted into the catch grooves 41*a* and 81*a* of the door guard mounting portions 49 and 89, and the surfaces to be supported 51*b* of the door guards 51 to 56 and 91 to 95 are placed on the support protrusions 41 and 81 of the door guard mounting portions 49 and 89 to be supported, with the consequence that the door guards 51 to 56 and 91 to 95 may be respectively mounted to the door guard mounting portions 49 and 89.

As shown in FIG. 1, shelf packaging assemblies 110 and 120 and door guard packaging assemblies 140 and 150 may be disposed in the freezing chamber 20 and the refrigerating chamber 60, respectively. In addition, stopper members 131 and 132 may be disposed to fix the shelf packaging assemblies 110 and 120 or the door guard packaging assemblies 140 and 150 in the freezing chamber 20 or the refrigerating chamber 60.

In one or more embodiments, the respective shelf packaging assemblies 110 and 120 refers to the shelves 31 to 34 and 71 to 73, shock-absorbing members 111 and 121 (see FIG. 3), and package members 112 and 122 (see FIG. 3) being respectively coupled to each other. In addition, the respective door guard packaging assemblies 140 and 150 refers to the door guards 51 to 56 and 91 to 95, shock-absorbing members 141 and 151 (see FIG. 5), and package members 142 and 152 (see FIG. 5) being respectively coupled to each other.

The shelf packaging assemblies 110 and 120 and the door guard packaging assemblies 140 and 150 may be respectively fixed in the storage chambers 20 and 60 so as not to move during transportation of the refrigerator 1. Although the shelf packaging assemblies 110 and 120 are fixed in the freezing chamber 20 and the door guard packaging assemblies 140 and 150 are fixed in the refrigerating chamber 60 in the present embodiment, embodiments are not limited thereto. For example, the shelf packaging assemblies 110 and 120 and the door guard packaging assemblies 140 and 150 may be fixed to any one position of the freezing chamber 20 and refrigerating chamber 60.

Accordingly, in the refrigerator 1 according to one or more embodiments, the shelves 31 to 34 and 71 to 73 (which may be mounted to the shelf mounting portions 21 and 61) and the door guards 51 to 56 and 91 to 95 (which may be mounted to the door guard mounting portions 49 and 89) are fixed in the freezing chamber 20 or the refrigerating chamber 60 in a state of being not mounted to the respective shelf mounting portions 21 and 61 and door guard mounting portions 49 and 89.

Hereinafter, the shelf packaging assemblies 110 and 120, the door guard packaging assemblies 140 and 150, and the stopper members 131 and 132 will be described in detail.

Figure 2:
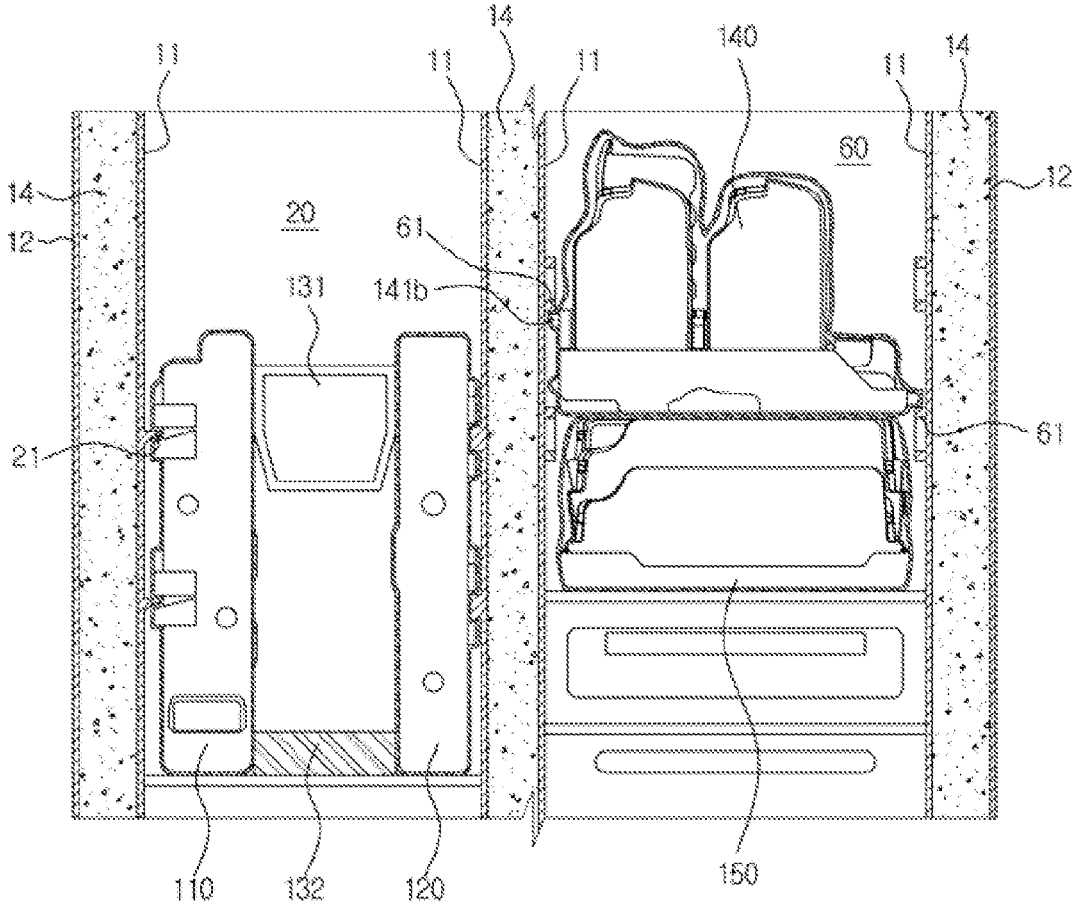
FIG. 2 is a view for explaining a structure of fixing shelf packaging assemblies and door guard packaging assemblies of the refrigerator in FIG. 1.
Figure 3:
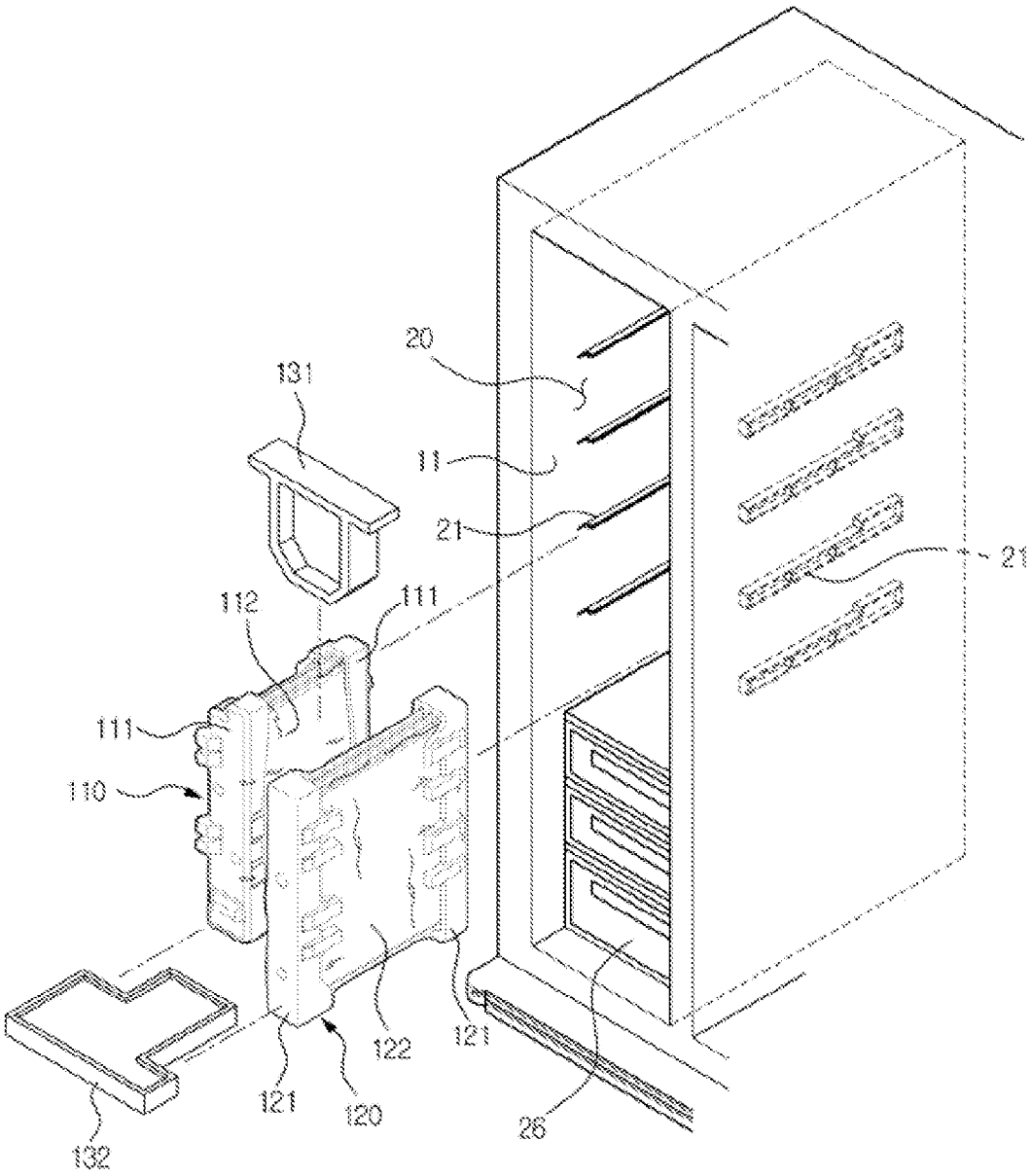
FIG. 3 is a view illustrating the shelf packaging assemblies and stopper members of the refrigerator in FIG. 1.
Figure 4:
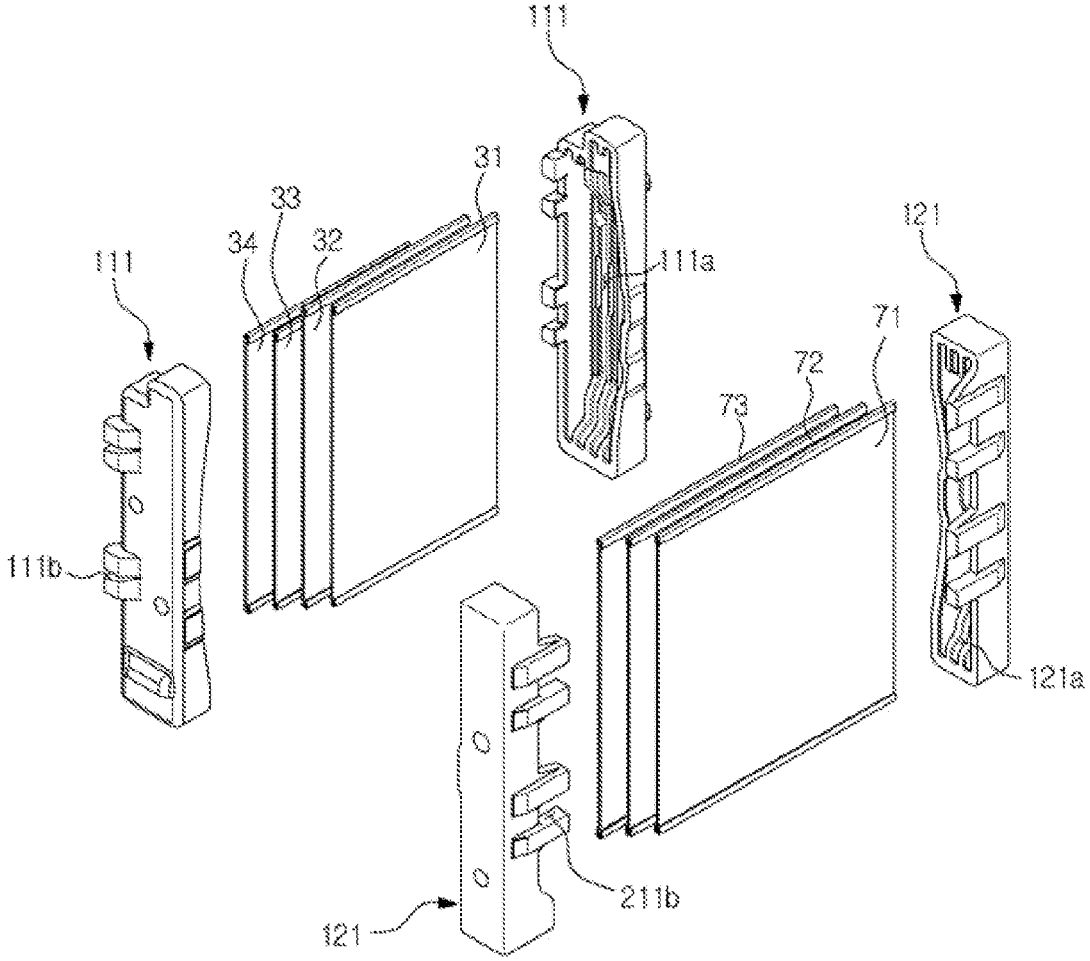
FIG. 4 is a view illustrating a coupling relation between each shelf and each shock-absorbing member of the refrigerator in FIG. 1.
Figure 5:
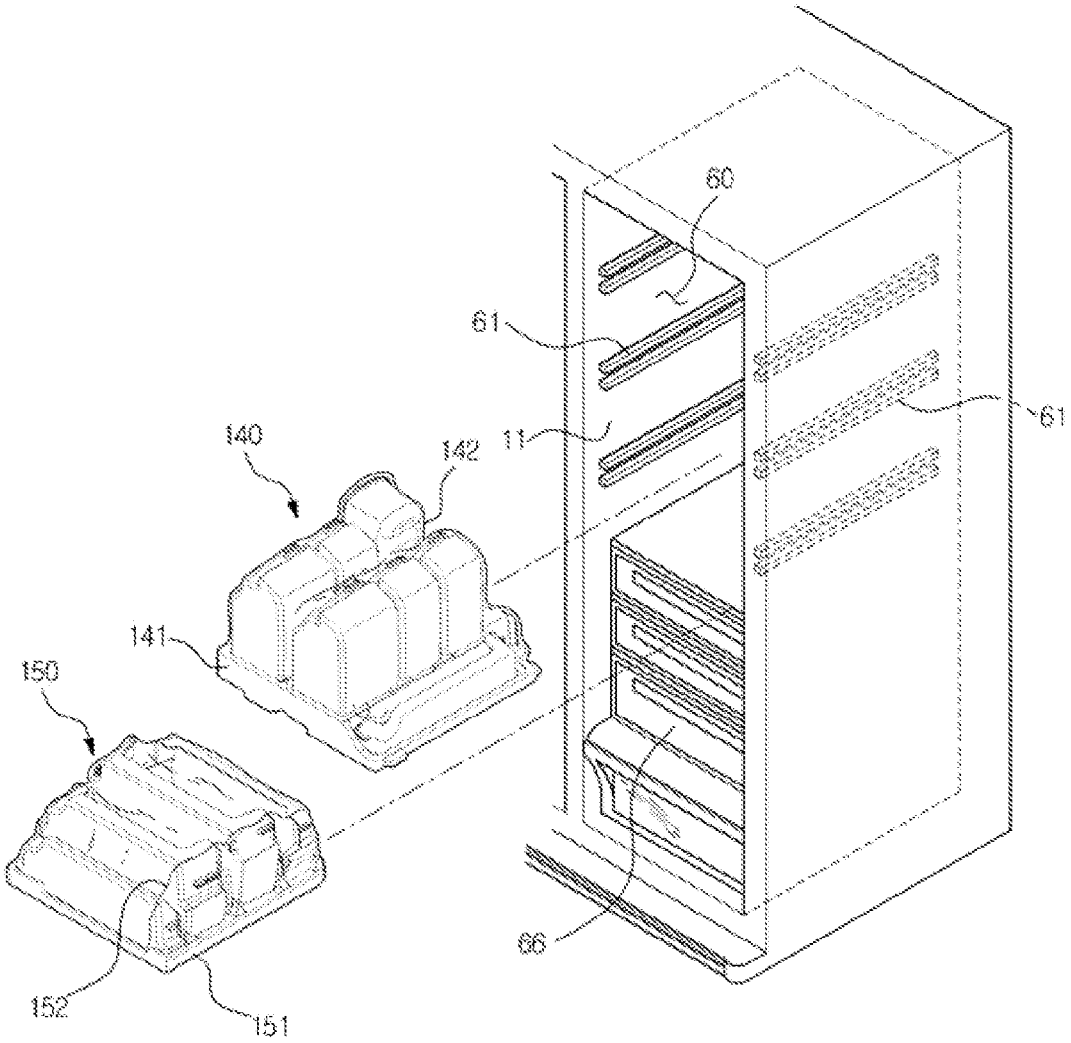
FIG. 5 is a view illustrating the door guard packaging assemblies of the refrigerator in FIG. 1.
Figure 6:
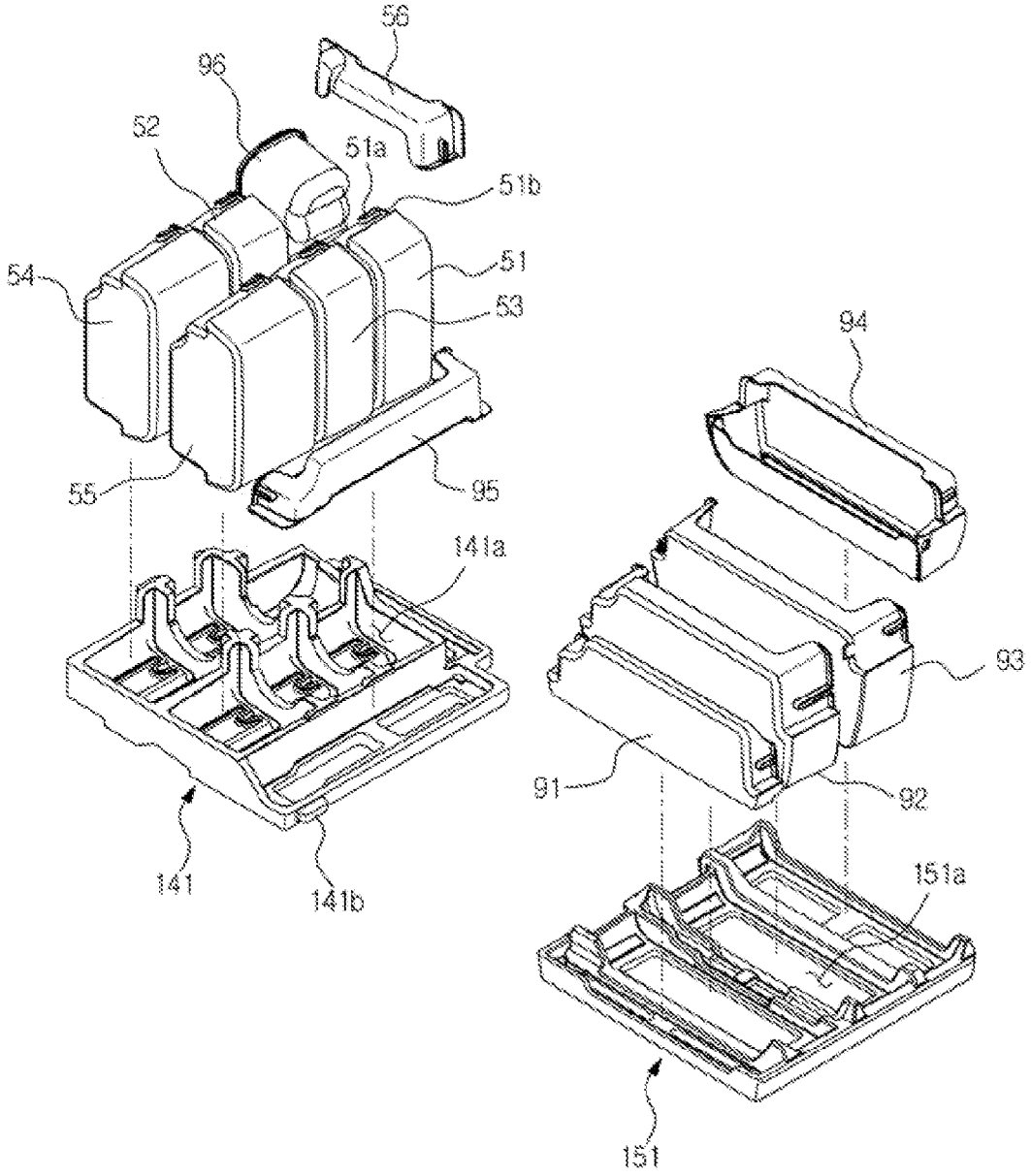
FIG. 6 is a view illustrating a coupling relation between each door guard and each shock-absorbing member of the refrigerator in FIG. 1.

FIG. 2 is a view for explaining a structure of fixing the shelf packaging assemblies and the door guard packaging assemblies of the refrigerator in FIG. 1. FIG. 3 is a view illustrating the shelf packaging assemblies and the stopper members of the refrigerator in FIG. 1. FIG. 4 is a view illustrating a coupling relation between each shelf and each shock-absorbing member of the refrigerator in FIG. 1. FIG. 5 is a view illustrating the door guard packaging assemblies of the refrigerator in FIG. 1. FIG. 6 is a view illustrating a coupling relation between each door guard and each shock-absorbing member of the refrigerator in FIG. 1

Referring to FIGS. 2 to 6, the shelf packaging assemblies 110 and 120 may include a first shelf packaging assembly 110 and a second shelf packaging assembly 120. The first shelf packaging assembly 110 may include the freezing chamber shelves 31 to 34 able to be mounted to the shelf mounting portion 21 in the freezing chamber 20, the shock-absorbing member 111, and the package member 112. The second shelf packaging assembly 120 may include the refrigerating chamber shelves 71 to 73 able to be mounted to the shelf mounting portion 61 in the refrigerating chamber 60, the shock-absorbing member 121, and the package member 122. However, the number and configuration of each of the shelf packaging assemblies 110 and 120 are illustrative and embodiments are not limited thereto.

In one or more embodiments, the respective shock-absorbing members 111 and 121 may have accommodation portions 111*a* and 121*a* which may accommodate at least a portion of the shelves 31 to 34 and 71 to 73. Thus, the shelves 31 to 34 and 71 to 73 may be coupled with the shock-absorbing members 111 and 121 by accommodating the shelves 31 to 34 and 71 to 73 in the accommodation portions 111*a* and 121*a*, respectively.

The respective shock-absorbing members 111 and 121 may be formed with fixing portions 111*b* and 121*b* which may be coupled to the shelf mounting portion 21 of the inner case 11. The respective fixing portions 111*b* and 121*b* may have grooves into which the shelf mounting portion 21 may be inserted. Thus, the shock-absorbing members 111 and 121 may be fixed in the freezing chamber 20 by inserting the shelf mounting portion 21 into the fixing portions 111*b* and 121*b*.

In addition, the shock-absorbing members 111 and 121 may come into close contact with the inner case 11 by the stopper members 131 and 132. That is, each of the shock-absorbing members 111 and 121 may be fixed in the freezing chamber 20 by being closely supported between the inner case 11 and each of the stopper members 131 and 132.

As such, in a state in which the shock-absorbing members 111 and 121 are fixed in the freezing chamber 20, the shelves 31 to 34 and 71 to 73 accommodated in the accommodation portions 111*a* and 121*a* may be spaced apart from the inner case 11 and the door 40. Consequently, friction between the shelves 31 to 34 and 71 to 73 and the inner case 11 and door 40 may not be generated during transportation of the refrigerator 1.

The shock-absorbing members 111 and 121 may be made of a Styrofoam material so as to absorb shock and safely protect the shelves 31 to 34 and 71 to 73. In addition, it is sufficient if the shock-absorbing members 111 and 121 simply have the accommodation portions 111*a* and 121*a* which may accommodate the shelves 31 to 34 and 71 to 73 and a structure of being able to be fixed in the freezing chamber 20. Therefore, each of the shock-absorbing members 111 and 121 is not limited to a particular form.

The stopper members 131 and 132 may also be made of a Styrofoam material. Furthermore, the stopper members 131 and 132 are not limited as to the number and shape thereof, and it is sufficient if the stopper members 131 and 132 allow the shock-absorbing members 111 and 121 to come into close contact with and be fixed to the inner case 11.

Moreover, the shelves 31 to 34 and 71 to 73 and the shock-absorbing members 111 and 121 may be respectively covered with the package members 112 and 122 in a state in which the shelves 31 to 34 and 71 to 73 and the shock-absorbing members 111 and 121 are coupled with each other. In one or more embodiments, each of the package members 112 and 122 may be a heat-shrinkable film. Thus, the shelves 31 to 34 and 71 to 73 and the shock-absorbing members 111 and 121 may be securely coupled with each other by contractive force of the package members 112 and 122, and the shelves 31 to 34 and 71 to 73 and the shock-absorbing members 111 and 121 may be prevented from being separated from each other during transportation of the refrigerator 1. In addition, since the package members 112 and 122 package the plural shelves 31 to 34 and 71 to 73 at once instead of packaging individually each of the same, packaging and releasing operations may be simplified.

The door guard packaging assemblies 140 and 150 may include a first door guard packaging assembly 140 and a second door guard packaging assembly 150. The first door guard packaging assembly 140 may include the door guards 51 to 56, 95 and 96, the shock-absorbing member 141, and the package member 142. The second door guard packaging assembly 150 may include the door guards 91 to 94, the shock-absorbing member 151, and the package member 152. However, the number and configuration of each of the door guard packaging assemblies 140 and 150 are illustrative and embodiments are not limited thereto.

In one or more embodiments, the door guards 51 to 56 may be mounted to the door guard mounting portion 49 of the freezing chamber door 40, the door guards 91 to 95 may be mounted to the door guard mounting portion 89 of the refrigerating chamber door 80, and the door guard 96 may be an oval box which may be accommodated in the door guard 94.

The respective shock-absorbing members 141 and 151 may have accommodation portions 141*a* and 151*a* which may accommodate at least a portion of the door guards 51 to 56 and 91 to 95. Thus, the door guards 51 to 56 and 91 to 95 may be coupled with the shock-absorbing members 141 and 151 by accommodating the door guards 51 to 56 and 91 to 95 in the accommodation portions 141*a* and 151*a*, respectively.

The shock-absorbing member 141 of the first door guard packaging assembly 140 may be formed with a fixing portion 141*b* which may be supported by the shelf mounting portion 61 of the inner case 11. The fixing portion 141*b* may have a protrusion shape which protrudes from the shock-absorbing member 141.

As shown in FIG. 2, the first and second door guard packaging assemblies 140 and 150 may be stacked in the refrigerating chamber 60. The first door guard packaging assembly 140 is stacked over the second door guard packaging assembly 150, and the fixing portion 141*b* of the first door guard packaging assembly 140 is supported by the shelf mounting portion 61. Consequently, the first and second door guard packaging assemblies 140 and 150 may be fixed in the refrigerating chamber 60.

As such, in a state in which the shock-absorbing members 141 and 151 are fixed in the refrigerating chamber 60, the door guards 51 to 56 and 91 to 95 accommodated in the accommodation portions 141*a* and 151*a* may be spaced apart from the inner case 11 and the door 80. Consequently, friction between the door guards 51 to 56 and 91 to 95 and the inner case 11 and door 80 may not be generated during transportation of the refrigerator 1.

The shock-absorbing members 141 and 151 may be made of a Styrofoam material so as to absorb shock and safely protect the door guards 51 to 56 and 91 to 95. In addition, it is sufficient if the shock-absorbing members 141 and 151 simply have the accommodation portions 141*a* and 151*a* which may accommodate the door guards 51 to 56 and 91 to 95 and a structure of being able to be fixed in the refrigerating chamber 60. Therefore, each of the shock-absorbing members 141 and 151 is not limited to a particular form.

The door guards 51 to 56 and 91 to 95 and the shock-absorbing members 141 and 151 may be respectively covered with the package members 142 and 152 in a state in which the door guards 51 to 56 and 91 to 95 and the shock-absorbing members 141 and 151 are coupled with each other. Each of the package members 142 and 152 may be a heat-shrinkable film. Thus, the door guards 51 to 56 and 91 to 95 and the shock-absorbing members 141 and 151 may be securely coupled with each other by contractive force of the package members 142 and 152, and the door guards 51 to 56 and 91 to 95 and the shock-absorbing members 141 and 151 may be prevented from being separated from each other during transportation of the refrigerator 1. In addition, since the package members 142 and 152 package the plural door guards 51 to 56 and 91 to 95 at once instead of packaging individually each of the same, packaging and releasing operations may be simplified.

Furthermore, bar-code labels, which may identify the accommodated shelves 31 to 34 and 71 to 73 and the accommodated door guards 51 to 56 and 91 to 95, may be attached to the shelf packaging assemblies 110 and 120 and the door guard packaging assemblies 140 and 150. Accordingly, it may be possible to efficiently manage distribution of the shelves 31 to 34 and 71 to 73 and the door guards 51 to 56 and 91 to 95.

As is apparent from the above description, in accordance with embodiments, it may be possible to prevent damage due to impact applied to an interior part such as a shelf or a door guard, to prevent a poor external appearance due to friction, and to prevent foreign matter such as dust from adhering thereto, during transportation of a refrigerator.

In addition, since a plurality of interior parts is assembled by one shock-absorbing member and is then simultaneously packaged, packaging and releasing operations may be simplified.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body having an inner case and an outer case;

a storage chamber which is defined to be opened at a front surface thereof by the inner case;

a door to open and close the opened front surface of the storage chamber;

a shelf mounting portion which is provided in the inner case;

a shelf which is configured to be mounted horizontally to the shelf mounting portion; and a shock-absorbing member which accommodates the shelf separated from the shelf mounting portion and which is fixed vertically within the storage chamber, so as to fix the shelf separated from the shelf mounting portion within the storage chamber, wherein the shelf has a horizontal mounted position and a vertical stored position that is orthogonal to the horizontal mounted position, wherein the shelf is secure in the vertical stored position within the shock-absorbing member when the shock-absorbing member is fixed vertically within the storage chamber, and wherein the shelf is configured to be mounted to the shelf mounting portion without use of the shock-absorbing member.

2. The refrigerator according to claim 1, wherein:

the shock-absorbing member comprises a fixing portion coupled to the shelf mounting portion; and the shock-absorbing member is fixed within the storage chamber by coupling the fixing portion to the shelf mounting portion.

3. The refrigerator according to claim 2, wherein:

the shelf mounting portion has a protrusion shape which protrudes from the inner case; and the fixing portion has a groove shape into which the shelf mounting portion is able to be inserted.

4. The refrigerator according to claim 1, further comprising:

a stopper member to fix the shock-absorbing member within the storage chamber, wherein the shock-absorbing member is closely arranged between the inner case and the stopper member to be fixed within the storage chamber.

5. The refrigerator according to claim 1, wherein the shelf accommodated in the shock-absorbing member is spaced apart from the inner case and the door.

6. The refrigerator according to claim 1, further comprising a package member which packages the shock-absorbing member and the shelf accommodated in the shock-absorbing member.

7. The refrigerator according to claim 6, wherein the package member is a heat-shrinkable film.

8. A refrigerator comprising:

a main body having an inner case and an outer case;

a storage chamber which is defined to be opened at a front surface thereof by the inner case;

a door to open and close the opened front surface of the storage chamber;

a shelf mounting portion which is provided in the inner case; and a shelf packaging assembly, which comprises a shelf configured to be mounted horizontally to the shelf mounting portion, a shelf shock-absorbing member to accommodate the shelf vertically within the storage chamber, and a shelf package member to package the shelf shock-absorbing member and the shelf accommodated in the shelf shock-absorbing member, and which is fixed within the storage chamber, wherein the shelf has a horizontal mounted position and a vertical stored position that is orthogonal to the horizontal mounted position, and wherein the shelf is secure in the vertical stored position within the shock-absorbing member and the shelf package member when the shelf packaging assembly is fixed vertically within the storage chamber.

9. The refrigerator according to claim 8, further comprising:

a door guard mounting portion which is provided on a rear surface of the door; and a door guard packaging assembly, which comprises a door guard able to be mounted to the door guard mounting portion, a door guard shock-absorbing member to accommodate the door guard, and a door guard package member to package the door guard shock-absorbing member and the door guard accommodated in the door guard shock-absorbing member, and which is fixed within the storage chamber.

10. The refrigerator according to claim 8, wherein the package member is a heat-shrinkable film.

* * * * *